US010041237B2

(12) United States Patent
Kerr

(10) Patent No.: US 10,041,237 B2
(45) Date of Patent: Aug. 7, 2018

(54) DEVICE FOR CHILD BATH SAFETY

(71) Applicant: Richard Malcolm Kerr, Gordon (AU)

(72) Inventor: Richard Malcolm Kerr, Gordon (AU)

( * ) Notice: Subject to any disclaimer, the term of this patent is extended or adjusted under 35 U.S.C. 154(b) by 154 days.

(21) Appl. No.: 15/128,272

(22) PCT Filed: Mar. 24, 2015

(86) PCT No.: PCT/AU2015/000168
§ 371 (c)(1),
(2) Date: Sep. 22, 2016

(87) PCT Pub. No.: WO2015/143479
PCT Pub. Date: Oct. 1, 2015

(65) Prior Publication Data

US 2017/0096805 A1 Apr. 6, 2017

(30) Foreign Application Priority Data

Mar. 25, 2014 (AU) ..... 2014901071

(51) Int. Cl.
*E03C 1/23* (2006.01)
*A47K 1/14* (2006.01)

(52) U.S. Cl.
CPC ..... *E03C 1/2302* (2013.01); *A47K 1/14* (2013.01); *E03C 2001/2311* (2013.01); *E03C 2001/2317* (2013.01)

(58) Field of Classification Search
CPC ..... E03C 1/2302; E03C 1/23; E03C 1/2306; F16K 31/48
USPC ..... 4/559
See application file for complete search history.

(56) References Cited

U.S. PATENT DOCUMENTS 2,067,204 A 1/1937 Richardson
2,669,240 A * 2/1954 Thorson ..... A47L 15/0086 134/104.2
2,982,307 A 5/1961 Mueller
3,566,418 A * 3/1971 Carlson ..... E03D 11/10 16/307
4,042,984 A * 8/1977 Butler ..... A47K 3/001 137/624.11
4,131,133 A * 12/1978 Huwe ..... A01G 25/165 137/624.11
4,563,780 A * 1/1986 Pollack ..... E03B 7/04 137/392

(Continued)

FOREIGN PATENT DOCUMENTS

GB 712807 A 7/1954
GB 2143262 A 2/1985

(Continued)

OTHER PUBLICATIONS

International Preliminary Report on Patentability.

(Continued)

*Primary Examiner* — Janie Loeppke
(74) *Attorney, Agent, or Firm* — PatshegenIP; Eva Taksel

(57) ABSTRACT

A device for controlling the duration of time water is retained in a bath tub or other liquid retaining receptacle; the device comprising a timer element and a plug assembly operable between a closed state and an opened state; the plug assembly changing from the closed state to the opened state at the expiry of a time duration pre-selected on the timer element.

11 Claims, 2 Drawing Sheets

(56) References Cited

U.S. PATENT DOCUMENTS

| | | | | |
|---|---|---|---|---|
| 5,682,628 | A * | 11/1997 | Oleson | A47K 3/001<br>4/559 |
| 2007/0039098 | A1 | 2/2007 | Ball | |
| 2009/0178192 | A1 | 7/2009 | Vassilev | |

FOREIGN PATENT DOCUMENTS

| | | | |
|---|---|---|---|
| GB | 2356562 | A | 5/2001 |
| WO | 2005124494 | A2 | 12/2005 |

OTHER PUBLICATIONS

International Search Report (appended to International Publication).
Supplementary European Search Report Oct. 30, 2017.

* cited by examiner

DEVICE FOR CHILD BATH SAFETY

TECHNICAL FIELD

The present invention relates to safety equipment and, more particularly to equipment for reducing the risk of child drownings.

BACKGROUND

Sadly, the drowning of children in domestic baths is an all to common occurrence. There can be many situations where children are at risk, either from lack of parental attention or where a bath has accidentally been left filled.

The filled bath tub becomes a high risk for young children. Often children enjoy baths for extended periods of time but a busy parent may get distracted, putting children at risk.

Devices for draining a bath in case of an emergency are known. For example U.S. Pat. No. 2,926,360 to Erickson et al, discloses a bathtub fitted with touch bars along the sides of the bath so that a person in the bath falling asleep or collapsing, is likely to hit his or her head on a bar, causing electrical energizing of a solenoid to open the drain plug. This is unlikely to be effective for children and in any case cannot act to limit the time a child spends in the water.

A safe technique of managing a child's bath time is to set a time limit to the amount of time they have to bath. Ideally a system that unplugs the bath and allows the water to drain would be advantageous however to date there has not been a device or system that allows the automated drainage of a domestic bath tub.

The described invention is designed to address these issues.

SUMMARY OF INVENTION

Accordingly, in one broad form of the invention there is provided, a device for controlling the duration of time water is retained in a bath tub or other liquid retaining receptacle; the device comprising a timer element and a plug assembly operable between a closed state and an opened state; the plug assembly changing from the closed state to the opened state at the expiry of a time duration pre-selected on the timer element.

Preferably, the timer element comprises a spring driven timer mechanism; a twist handle rotatable relative a timer dial providing for selection of the time duration Preferably, the plug assembly includes a lid and seal; the plug assembly maintained in a closed state by a catch or lip engaging with the lid of the plug assembly to engage the seal in an aperture in a base of the plug assembly.

Preferably, a spring loaded hinge of the lid and plug assembly urges the lid and plug assembly into a rotated open position when the catch or lip is disengaged from the lid.

Preferably, the catch or lip is disengaged from the lid of the lid and seal assembly when the timer element reaches the pre-selected time duration.

Preferably, the plug assembly is provided with a plurality of water flow ports around a periphery of the timer mechanism; the water flow ports allowing water to pass through the ports, past the lid and seal assembly when opened and out through a drain below the bathtub.

Preferably, the timer assembly provides for a range of pre-selectable time durations.

Preferably, the timer element is an electronic control element; the electronic control element communicating with a solenoid of the plug assembly acting to maintain a lid and seal assembly of the plug assembly in a closed state until a pre-selected time duration set on the control element has elapsed.

In yet a further broad form of the invention, there is provided a method of controlling the time during which water or another liquid is retained in a bathtub or other liquid retaining receptacle; the method including;

selecting a time duration from a range of time durations provided in a timer mechanism of a plug assembly, Inserting the plug assembly in a waste opening of the bath tub or other liquid retaining receptacle with a lid and seal assembly in a closed state.

Preferably, a catch or lip of the timer mechanism engages with the lid of the lid and seal assembly to maintain the lid and seal assembly in a closed state for the duration of the selected time.

Preferably, the lid and seal assembly rotates between a closed state and an open state under urging of a spring loaded hinge; the spring loaded hinge rotating the lid and seal assembly into an open state when the catch of lip is disengaged by the timer mechanism.

Preferably, the time duration is selectable on an electronic timer module; the electronic timer module communicating with a solenoid acting on the lid and seal assembly.

DESCRIPTION AND OPERATION

First Preferred Embodiment

Figure 1:
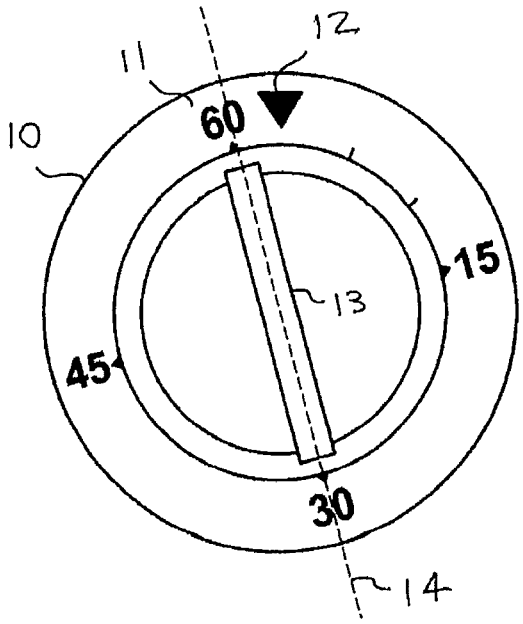
FIG. 1—plan view of example embodiment

FIG. 1 discloses a plan view of preferred embodiment of the invention. A bath plug assembly 10 incorporates a timer mechanism 11 similar in operation to devices such as an egg timer but built with water and corrosion resistant materials. A twist handle 13 rotating in a timer dial allows the user to set the timer to the desired delay before triggering the device. Preferably, the timer can be set to any time from one to sixty minutes.

When the device reaches its delay limit 12, a trigger is set that allows the device to commence draining the bathtub of water through the plug assembly 10.

Figure 2A:
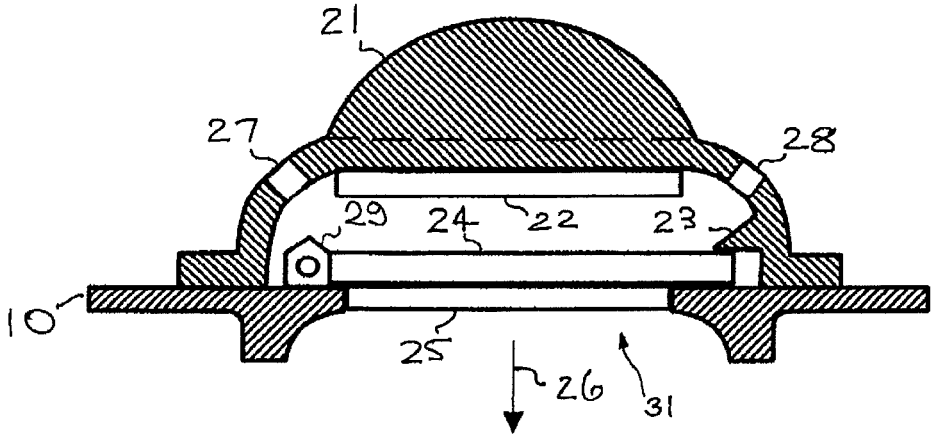
FIG. 2*a*—cross section side elevation of example embodiment in closed mode

FIG. 2*a* discloses the example embodiment in a cross section elevation side view. The example embodiment shows the device in a closed mode. This means that the device is configured so as not to allow water to pass through it to drain the bath.

The plug assembly 10 contains a rotating timer piece 21 that includes the twist handle 13 that allows a user to easily set the length of the desired timer delay. In this embodiment a spring mechanism 22 as well known in the art is used to advance the timing mechanism as the timer counts down.

Within the plug assembly 10 is a plug lid and seal assembly 31, including a lid 24 and a seal 25 which as shown in FIG. 2*a*, are in a closed mode meaning that they are positioned to stop water from escaping through the plug to the drain 26 below. The lid and seal assembly 31 has a spring loaded hinge on one side 29 and is kept in the normally closed position shown in FIG. 2*a* by an internal lip or catch 23. The lip holds the lid and seal assembly in place, with the seal 25 seated in an aperture in the base of the plug assembly until the timer is triggered at which point the lip is released and the spring loaded hinge rotates the lid and seal assembly 31 into the opened position as illustrated in FIG. 2*b*.

The plug assembly 10 also features multiple water flow ports 27, 28 of which only two of many are shown, around the periphery of the timer mechanism 11. The number of ports would be such that water can freely enter the inside area of the plug in order to escape down the drain when the trigger is enabled.

Figure 2B:
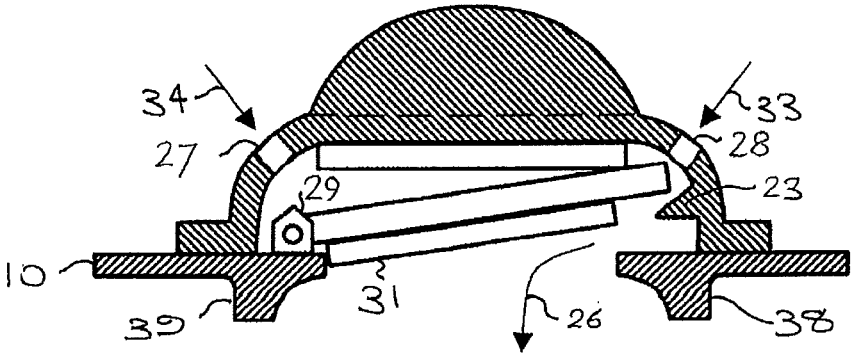
FIG. 2*b*—cross section side elevation of example embodiment in open mode

FIG. 2*b* shows the example embodiment in cross section side elevation in open mode. In this mode the device has been triggered. This means that the lip or catch 32 has been removed from keeping the plug lid and seal assembly 31 in place and the spring loaded hinge 38 has forced the lid and seal assembly 31 open.

This action allows water to freely flow from outside of the plug 34, 33 to the inside of the plug through flow ports 27,28 and then out through the drain 26.

The lower outside edges of the plug 39, 38 typically connect with and seal the top and inside edge of a drain hole of a water receptacle such as a bath.

The result is a device that allows users to set a time limit before the bath begins to be emptied which is desirable in many situations including but not limited to occasions where parents want to allow their children to spend a limited amount of time enjoying the bath but do not want to leave their children for un unregulated amount of time around water where the possibility of drowning is of concern.

Alternative Embodiments

The example embodiment uses a spring mechanism and spring loaded hinge to control the countdown of the timer and to trigger the opening of the lid within the plug assembly. An alternative embodiment could include any type of timer mechanism including but not limited to an electronic device capable of achieving the same results.

In this further preferred embodiment of an electronic device, the lid and seal assembly is controlled by a solenoid mounted in a waterproof enclosure. A battery or mains powered controller is connected to the bath plug assembly by cable with the control module external to the bath and preferably secured out of reach of children. The timer in this case may still be a spring operated mechanism as for the first embodiment described above, but may preferably be an electronic timer module and include a key pad and display.

The example embodiments allow water to pass through the assembly at the time of triggering. An alternative embodiment could include but not be limited to raising the whole plug up and away from the bath tub plug area to allow water to escape the bath. In this arrangement the plug assembly may be a conventional bath plug connected by a cable to a mechanical or electro-mechanical actuator and timer module, located external to the bath. When the pre-selected trigger time is reached, the actuator draws on the cable to pull the plug assembly from the waste opening.

An alternative embodiment could use any type of timing device and any configuration of plug position change that allows the bath to be emptied.

The example embodiment is used in the context of a typical consumer bath tub. An alternative embodiment could use the device and any alternative embodiment of the device in any size or shape of receptacle where it desirable to use a timer to allow a liquid to drain from the receptacle.

In Use

In use, the plug assembly of the invention is placed in the waste opening of a bathtub or other water retaining receptacle with the lid and seal of the assembly in the closed state. The timer mechanism is then set to the desired time duration and the bath or receptacle filled with water in the normal manner.

At the elapse of the selected time duration, the lid and seal assembly is released and rotates to the opened state to allow water to drain to the waste below.

The invention prevents a child being left in a bath unsupervised for an undue extended period in which a child could, for example fall asleep and become at risk of drowning.

It will be understood that apart from acting as a safety device in the bathing of young children, the device may be used for example in experiments, where the duration of water retention in a receptacle is critical to the operation.

The invention claimed is:

1. A bath plug assembly for controlling the duration of time water is retained in a bath tub or other liquid retaining receptacle; the bath plug assembly comprising an integral timer element and a lid and seal assembly; the lid and seal assembly operable between a closed state and an opened state; the lid and seal assembly changing from the closed state to the opened state at the expiry of a time duration pre-selected on the timer element, wherein the timer element comprises a spring driven timer mechanism; a twist handle rotatable relative a timer dial providing for selection of the time duration.

2. The bath plug assembly of claim 1 wherein the lid and seal assembly is maintained in a closed state by a catch or lip engaging with the lid of the lid and seal assembly to engage the seal in an aperture in a base of the bath plug assembly.

3. The bath plug assembly of claim 2 wherein a spring loaded hinge of the lid and seal assembly urges the lid and seal assembly into a rotated open position when the catch or lip is disengaged from the lid.

4. The bath plug assembly of claim 3 wherein the catch or lip is disengaged from the lid of the lid and seal assembly when the timer element reaches the pre-selected time duration.

5. The bath plug assembly of claim 1 wherein the plug assembly is provided with a plurality of water flow ports around a periphery of the timer mechanism; the water flow ports allowing water to pass through the ports, past the lid and seal assembly when opened and out through a drain below the bathtub or other liquid retaining receptacle.

6. The bath plug assembly of claim 1 wherein the timer assembly provides for a range of pre-selectable time durations.

7. The bath plug assembly of claim 1 wherein the timer element is an electronic control element; the electronic control element communicating with a solenoid of the bath plug assembly acting to maintain the lid and seal assembly of the bath plug assembly in a closed state until a pre-selected time duration set on the control element has elapsed.

8. A method of controlling the time during which water or another liquid is retained in a bathtub or other liquid retaining receptacle by means of a bath plug assembly; the method including;

selecting a time duration from a range of time durations provided in a timer mechanism incorporated within the bath plug assembly, closing a lid of a lid and seal assembly within the bath plug assembly, Inserting the bath plug assembly in a waste opening of the bath tub or other liquid retaining receptacle with the lid and seal assembly in the closed state.

9. The method of claim 8 wherein a catch or lip of the timer mechanism engages with the lid of the lid and seal assembly to maintain the lid and seal assembly in a closed state for the duration of the selected time.

10. The method of claim 9 wherein the lid and seal assembly rotates between a closed state and an open state under urging of a spring loaded hinge; the spring loaded hinge rotating the lid and seal assembly into an open state when the catch or lip is disengaged by the timer mechanism.

11. The method of claim 8 wherein the time duration is selectable on an electronic timer module; the electronic timer module communicating with a solenoid acting on the lid and seal assembly.

* * * * *